US007182603B1

(12) United States Patent
Koneda et al.

(10) Patent No.: US 7,182,603 B1
(45) Date of Patent: Feb. 27, 2007

(54) ELECTRONIC VALVE ACTUATOR ELECTRICAL CONNECTOR

(75) Inventors: Philip Koneda, Novi, MI (US); Neal Corey, Canton, MI (US); Allan Gale, Livonia, MI (US)

(73) Assignee: Ford Global Technologies, LLC, Dearborn, MI (US)

( * ) Notice: Subject to any disclaimer, the term of this patent is extended or adjusted under 35 U.S.C. 154(b) by 0 days.

(21) Appl. No.: 11/275,235

(22) Filed: Dec. 20, 2005

(51) Int. Cl.
*H01R 33/00* (2006.01)

(52) U.S. Cl. ..... 439/34; 439/130; 439/608; 123/568.11; 251/129.12

(58) Field of Classification Search ..... 439/34, 439/130, 682, 607–608, 364; 123/568.21, 123/568.11; 251/129.15, 129.12
See application file for complete search history.

(56) References Cited

U.S. PATENT DOCUMENTS 5,020,773 A 6/1991 Tuft et al.
5,494,255 A * 2/1996 Pearson et al. ..... 251/129.15
6,178,956 B1 * 1/2001 Steinmann et al. .... 123/568.21
6,230,694 B1 * 5/2001 Cook et al. ..... 123/568.11
6,374,814 B1 * 4/2002 Cook et al. ..... 123/568.21
6,409,102 B1 6/2002 Luttrell et al.
6,565,020 B1 5/2003 Fischer et al.
6,672,272 B2 1/2004 McGloin

* cited by examiner

*Primary Examiner*—Michael C. Zarroli
(74) *Attorney, Agent, or Firm*—Gary A. Smith

(57) ABSTRACT

An electrical connector for mounting to an electronically controlled valve assembly of an internal combustion engine and for electrically connecting the valve assembly to a control system for the engine. The electrical connector has disposed in a housing thereof: a plurality of high current conductors for carrying relatively high current to the electromagnet coils of the valve assembly and a plurality of low current conductors for carrying relatively low current valve position sensing signals from the valve assembly; and a pair of electrical shields, one of the pair of shields being disposed around the plurality of high current conductors and the other one of the pair of shields being disposed around the plurality of low current conductors.

5 Claims, 13 Drawing Sheets

ELECTRONIC VALVE ACTUATOR ELECTRICAL CONNECTOR

TECHNICAL FIELD

This invention relates generally to electronic valve actuators and more particularly to electrical connectors used with such actuators.

BACKGROUND

As is known in the art, one common approach to electronically control the valve actuation of an internal combustion engine is to have two electromagnets toggle an armature coupled to the valve between an open position and a closed position. The position of the valve is controlled by a valve actuator which includes an electromagnetic valve actuator with upper and lower coils which electromagnetically drive an armature connected to the valve against the force of upper and lower springs for controlling movement of the valve. More particularly, when a first, here upper, one of the electromagnets is activated by a relatively high current, the armature is attracted to the activated electromagnet thereby driving the valve to its closed position. Also, as the armature is attracted to the activated electromagnet, a first spring, in contact with the upper end of the armature is compressed. When the first electromagnet is deactivated, the first compressed spring releases its stored energy and drives the armature downward thereby driving the valve towards its open position. As the armature approaches the second, lower electromagnet, the second electromagnet is activated by a relatively high current pulling the valve to its full open position. It is noted that a second, lower spring becomes compressed during the process, i.e., during capture of the armature by the activation of the second electromagnet. After being fully open for the desired period of time, the second lower electromagnet is deactivated, and the lower spring releases its stored energy and thereby drives the armature towards its upper position, the first electromagnet is activated and the process repeats. Thus, the two electromagnets toggle the armature coupling to the valve between an open or closed position where it is held, while the pair of springs is used to force the valve to move (oscillate) to the other state. A position sensor produces a relatively low current electronic signal in response to the position of the armature relative to the fixed coils. A controller is operatively connected to the position sensor and to the upper and lower coils in order to control actuation and landing of the valve.

As is also known, many engines include two intake valves per cylinder. Thus, for each cylinder eight high current terminals, or conductors, are required (two terminals per coil for each of the pair of coils for each of the two intake valves) and six low current signal-carrying terminals, or conductors, are required (three for each on the two intake valves).

Thus, an electrical connector is required to connect to these conductors with a low profile package, is able to seal against both the internal engine and under hood environments, and carry the electrical currents necessary to deliver actuator performance. The electrical connector must also meet EMI/EMC, which requires a shield path around the electrical wires and through the connector to the actuator housing. In addition to carrying the high current needed for valve actuation, the connector is also needed to provide the voltage source, ground and return for reporting low current signal sensing armature position signals to the valve controller. Since these signals are low voltage and low current, isolation from the higher currents needed for valve actuation is necessary. One option suggested is to provide separate electrical connectors for valve motion control and signal processing. However, the extremely tight packaging constraints within the cylinder head make the packaging of two independent connectors per pair of actuators very difficult and relatively expensive.

SUMMARY

In accordance with the present invention, an electrical connector for mounting to an electronically controlled valve assembly of an internal combustion engine and for electrically connecting the valve assembly to a control system for the engine. The electrical connector includes: a housing; and a plurality of high current conductors for carrying relatively high current to the electromagnet coils of the valve assembly disposed in the housing and a plurality of low current conductors for carrying relatively low current valve position sensing signals from the valve assembly disposed in the housing. The housing provides a common housing for both the plurality of high current conductors and the plurality of low current conductors.

In one embodiment, a pair of electrical shields is provided, one of the pair of shields being disposed around the plurality of high current conductors and the other one of the pair of shields being disposed around the plurality of low current conductors.

In one embodiment, a housing comprises: (A) a upper portion comprising: (i) a plurality of upper high current conductors and a plurality of upper low current conductors; (ii) a pair of upper electrical shields, one of the pair of upper electrical shields being disposed around the plurality of upper high current conductors and the other one of the pair of upper electrical shields being disposed around the upper low current conductors; (B) a lower portion comprising: (i) a plurality of lower high current conductors and a plurality of lower low current conductors, each one being electrically connected to a corresponding one of the plurality of upper high current conductors and the plurality of upper low current conductors; (ii) a pair of lower electrical shields, one of the pair of lower electrical shields being disposed around the plurality of lower high current conductors and the other one of the pair of lower electrical shields being disposed around the lower low current conductors. In one embodiment, the upper portion comprises: (i) a plurality of electrically insulated upper high current conductors and a plurality of electrically insulated upper low current conductors; (ii) a first upper electrical shield portion disposed around the plurality of upper high current conductors; (iii) a second upper electrical shield portion disposed around the upper low current conductors. The lower portion comprises: (i) a plurality of electrically insulated lower high current conductors and a plurality of electrically insulated lower low current conductors; (ii) a first lower electrical shield portion disposed around the plurality of lower high current conductors; (iii) a second lower electrical shield portion disposed around the lower low current conductors. Each one of the plurality of upper low current conductors is electrically connected to a corresponding one of the plurality of lower low current conductors; (ii) the first upper electrical shield portion is connected to the first lower electrical shield portion; (iii) the second upper electrical shield portion is connected to the second lower electrical shield portion.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION

Figure 1:
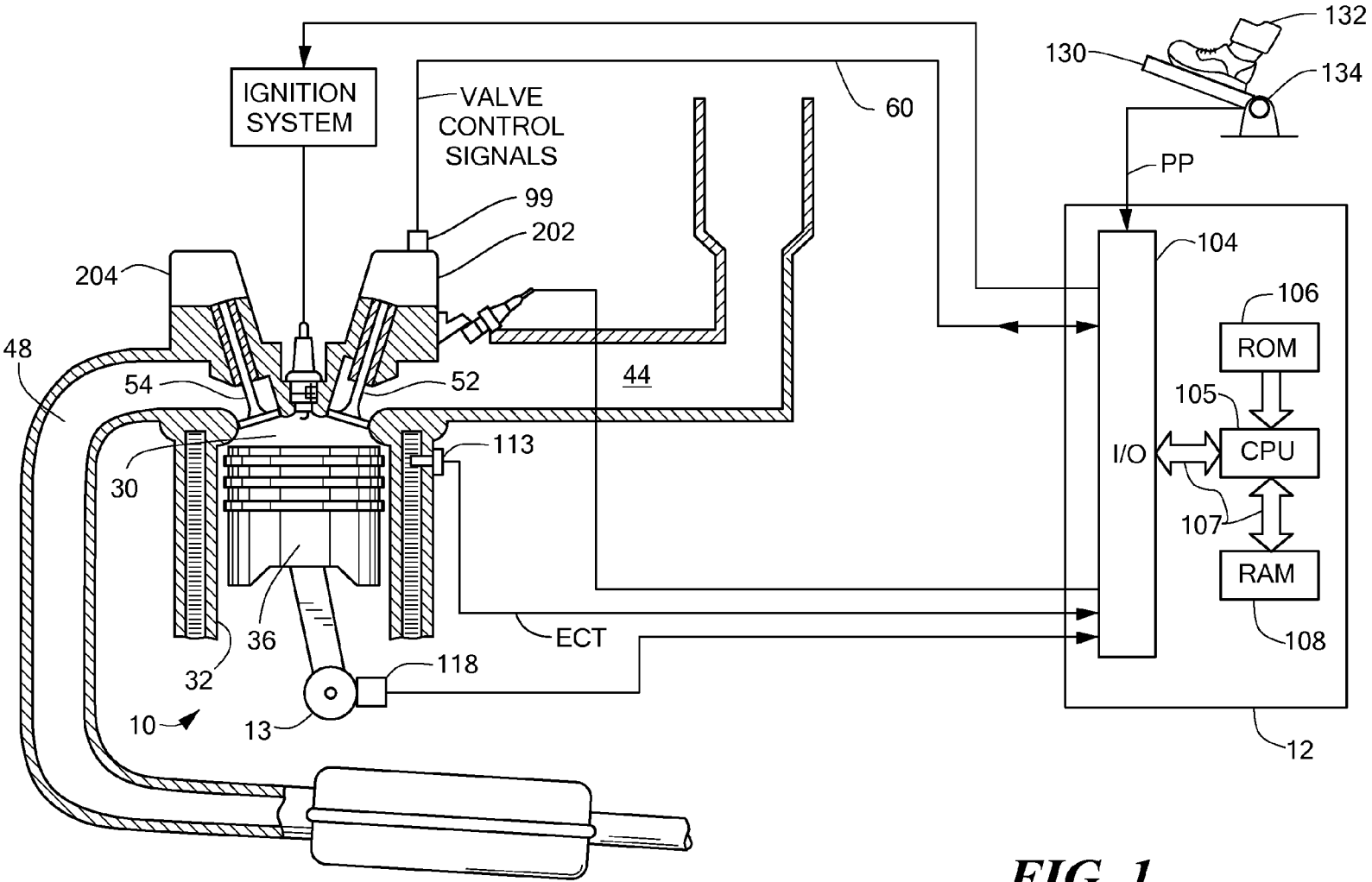
FIG. 1 is a block diagram of an engine system having an electronically controlled valve system according to the invention.

Referring now to FIG. 1, a simplified block diagram of a camless internal combustion engine 10 is shown using a valve control method and system in accordance with the present invention. The engine 10 includes a plurality of cylinders (only one shown) each having a combustion chamber 30 and cylinder walls 32 in cooperation with piston 36 positioned therein and coupled to a crankshaft 13. The combustion chamber 30 communicates with corresponding intake and exhaust manifolds 44 and 48, respectively, via intake and exhaust valves 52 and 54. Here, both the intake and exhaust valves 52 and 54 are actuated via corresponding electromechanical or electromagnetic actuators 202 and 204, respectively. It should be understood that in some applications, only the intake valve 52 is electronically controlled, with the exhaust valves opening and closing controlled by a conventional mechanical camshaft.

Figure 2B:
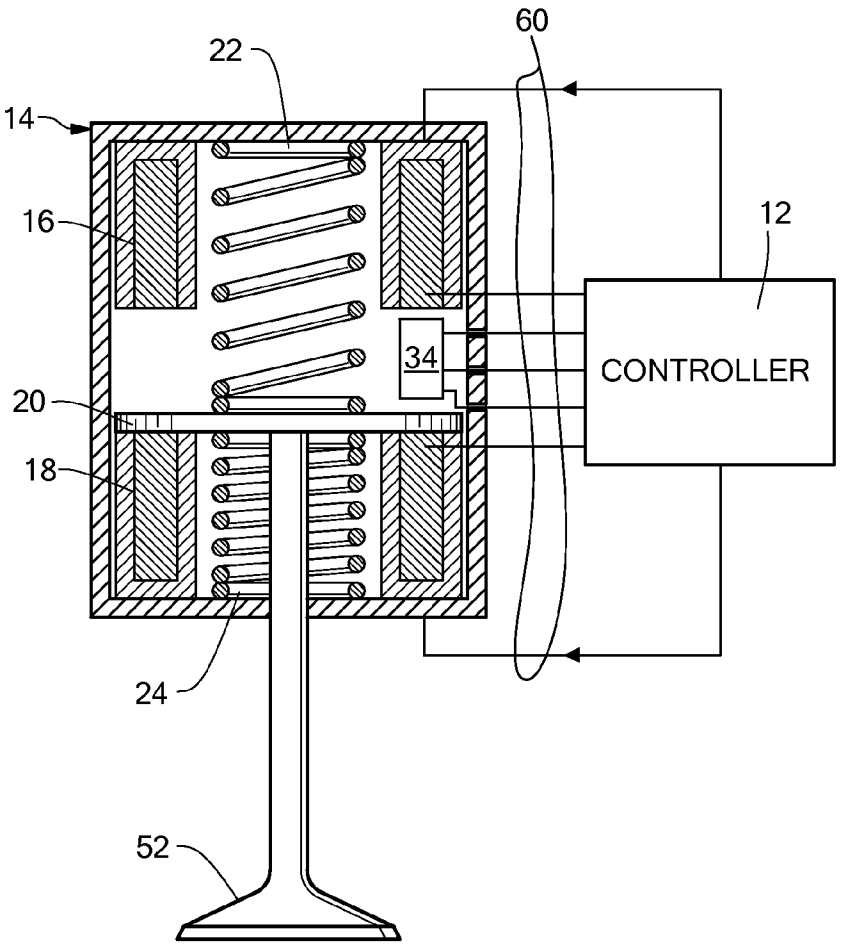
FIGS. 2A and 2B are diagrammatically sketches showing a valve actuation system, for a single valve, such FIGS. 2A and 2B showing the valve in a closed position and an open position, respectively.
Figure 2A:
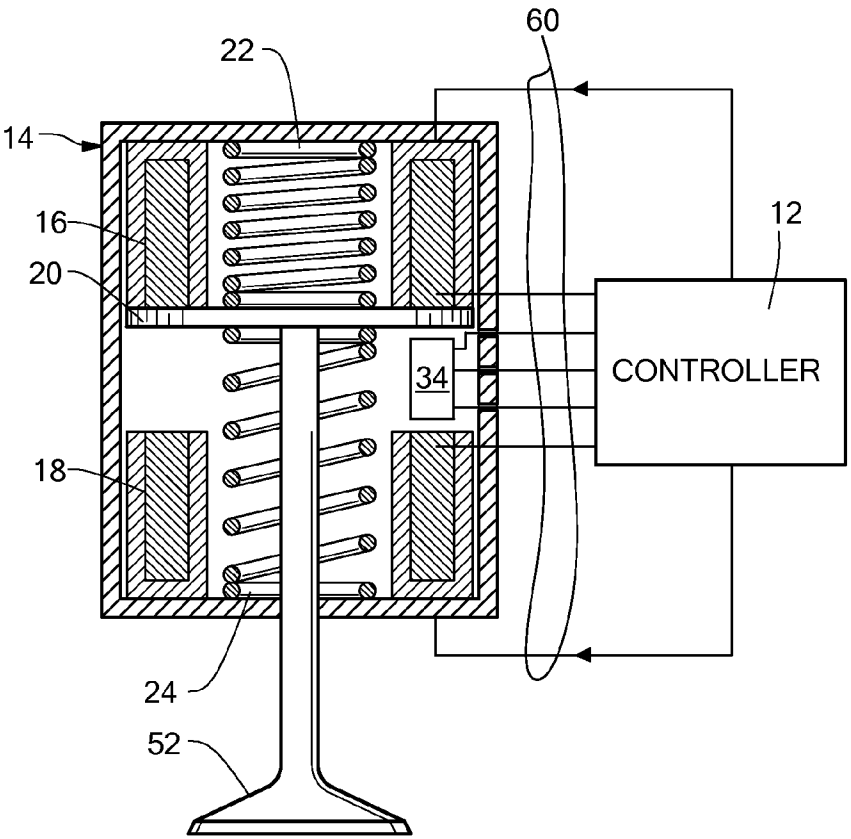

An exemplary one, here intake valve 52 is shown in FIGS. 1, 2A and 2B. The valve actuator 202 is electrically connected to a controller 12 through a removable electrical connector 99. Likewise, with an electronically controlled exhaust valve, the actuator 204 would be electrically connected to the controller 12 through a removable electrical connector similar to 99.

Thus, referring to FIGS. 2A and 2B, a diagrammatic sketch is shown wherein valve control signals on bus 60 control movement of a valve 52 in a camless engine between a fully closed position (shown in FIG. 2A), and a fully open position (shown in FIG. 2B). The position of valve 52 is controlled by a valve actuator which includes an electromagnetic valve actuator (EVA) 14 with upper and lower coils 16,18 which electromagnetically pull an armature 20 against the force of upper and lower springs 22, 24 for controlling movement of the valve 52.

A position sensor 34 (FIGS. 2A and 2B) is provided to produce an electronic signal in response to the position of the armature 20 relative to the fixed coils 16, 18. The controller 12 is operatively connected to a position sensor 34, and to the upper and lower coils 16, 18 in order to control actuation and landing of the valve 52.

It is noted that the engine controller 12 also receives various signals from sensors coupled to engine 10, the sensors including but not limited to: a temperature sensor 113 coupled to cooling jacket for measuring engine coolant temperature (ECT); a pedal position sensor 134 for providing the accelerator pedal 130 position (PP) as commanded by the driver 132; and an engine speed sensor 118 coupled to crankshaft 13 for indicating the operating speed of the camless internal combustion engine. Preferably, the engine controller 12 includes a microprocessor unit 105, input/output ports 104 containing power circuitry to activate the coils 16 and 18, random access memory (RAM) 108, read-only memory (ROM) 106, and a data bus 107. The RAM and ROM are semiconductor chips. Here ROM 106 stores a computer program for providing control signals to the power circuitry activating coils 16, 18 in a manner to be described herein after. Suffice it to say here that based at least in part on position signals produced by sensors 34 and 118 the engine controller 12 drives one or more coils to actuate the valves. More particularly, the valve control signals on a bus 60 connected to the controller 12 include wires for carrying the high current to the coils 16, 18 and the low current signals from position sensor 34.

Referring again to FIGS. 2A and 2B, the valve motion is governed through the forcing of the armature by the opposing sets of electromagnets and springs. A typical operation begins with the armature held against either the upper or lower magnetic coil 16, 18. This creates an imbalance between the opposing springs 22, 24 which will drive the armature 20 across the gap between the coils 16, 18 when the current in the releasing coil 16, 18 is sufficiently reduced. As the armature 20 nears the opposite side, it is caught by and held against the remaining electromagnetic coil 18, 16 to complete the transition, or valve stroke. Once again an imbalance is created in the opposing springs 22, 24 which is used to reverse the process. The spring forces are balanced when the armature 20 is equidistant from each magnetic coil 16, 18 as described in U.S. Pat. No. 6,397,797 issued Jun. 4, 2002, inventors Kolmanovsky et al. assigned to the same assignee as the present invention. Another EVA system is described in U.S. Pat. No. 6,810,841 entitled Electronic valve actuator control system and method, inventors Katherine Peterson et al., assigned to the same assignee as the present invention.

Figure 3:
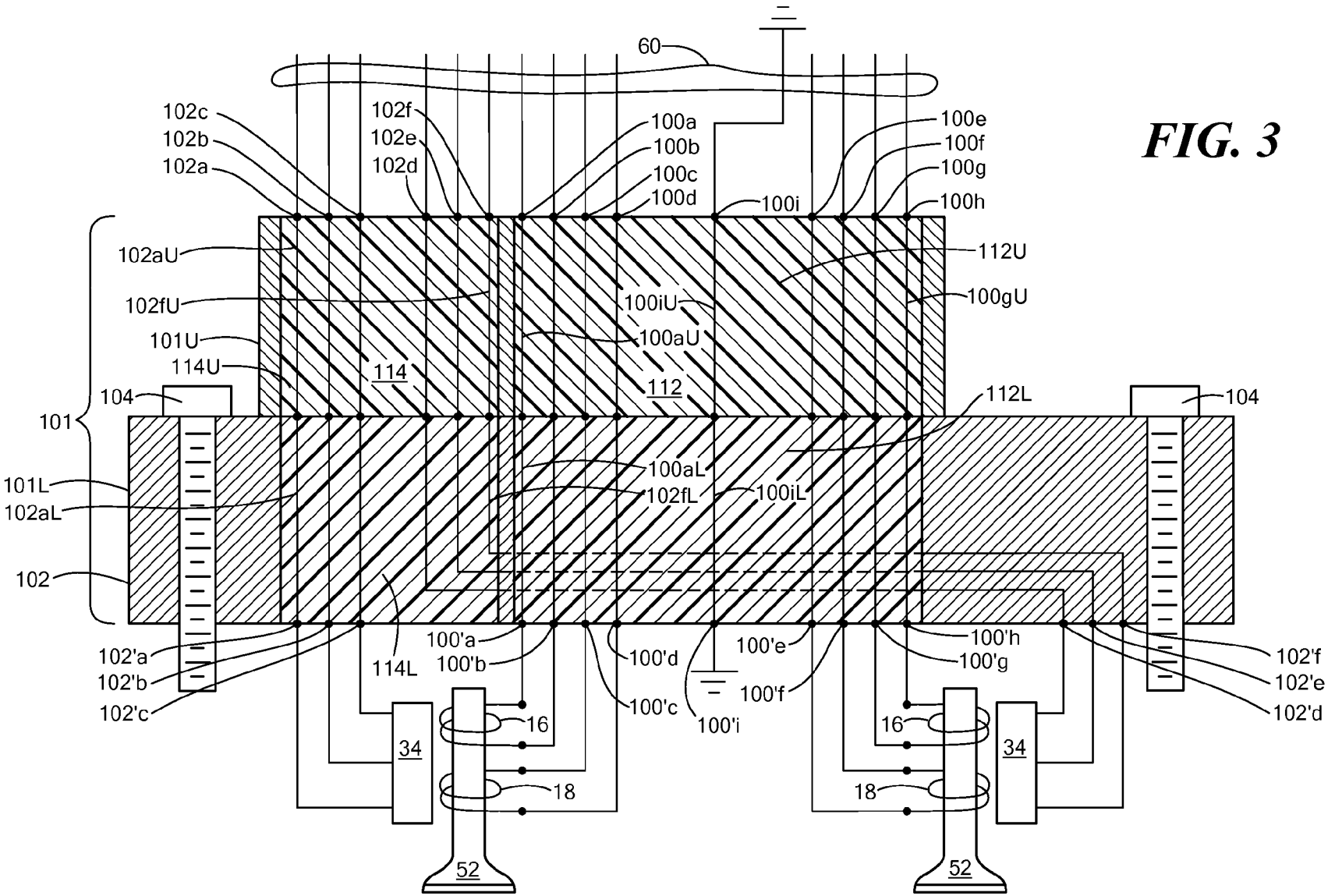
FIG. 3 is a schematic diagram of a valve assembly, for a two valve actuator assembly, mounted to an electrical connector according to the invention.

Here, each cylinder includes two intake valves and therefore the electromagnetic actuators 202 requires, for each cylinder, eight high current conductors, indicated as electrically isolated terminals 100'*a*–100'*h* in FIG. 3, are required (two terminals for each of the pair of coils 16, 18 for each of the two intake valves), one ground reference indicated as electrically isolated terminal 100'*i* and six low current position sensing signal electrically isolated terminals indicated as terminals 102'*a*–102'*f* in FIG. 3 are required (three for each on the two intake valves).

Figure 12:
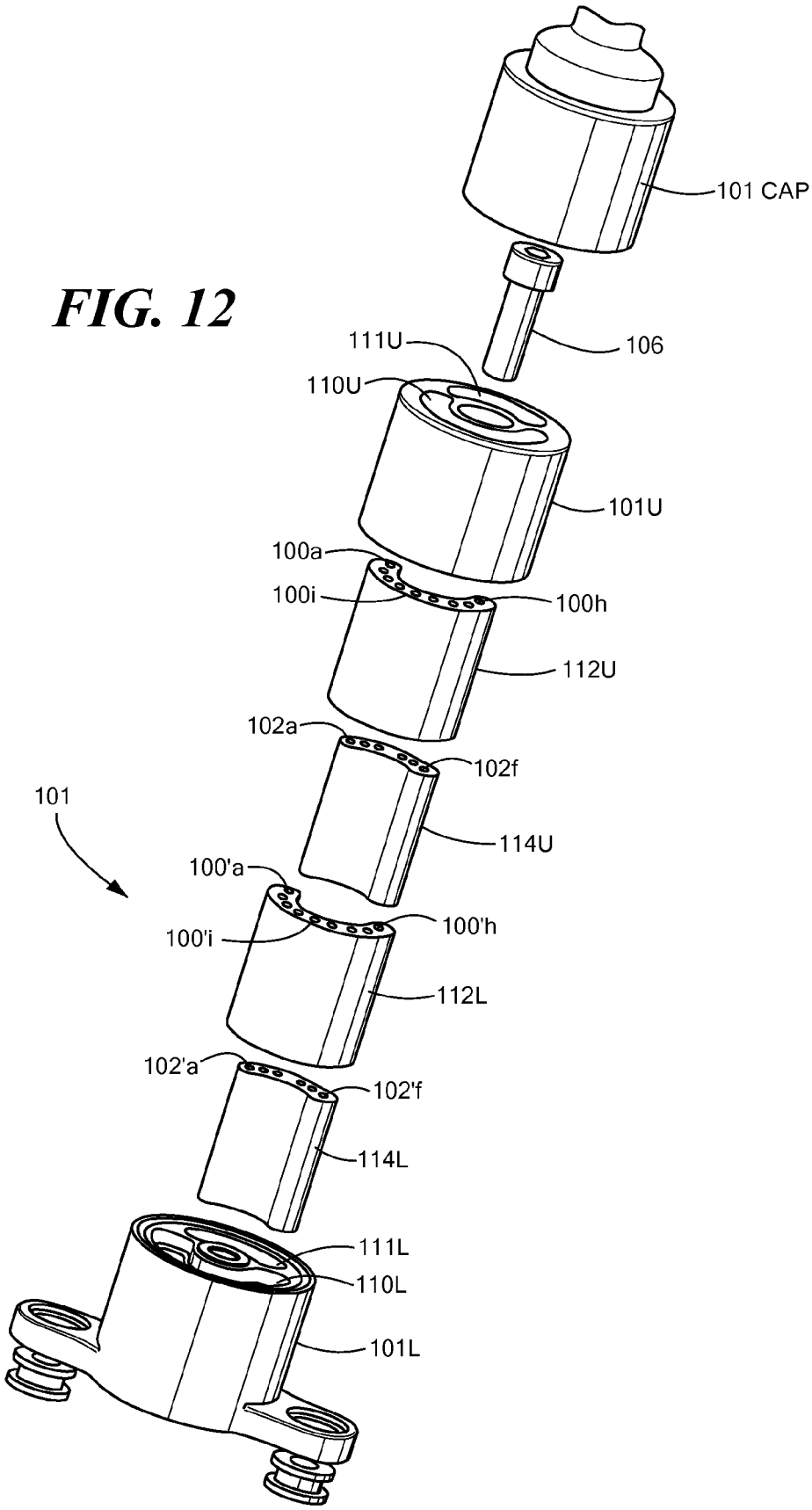
FIG. 12 is an exploded sketch of the electrical connector assembly of FIG. 4.

Referring now also to FIG. 12, the electrical connector 99 has an outer, three-piece or portion, conductive metallic housing 101. More particularly, the connecter 99 has the housing 101 has upper, lower portion and cap 101U, 101L, 101CAP. The lower portion 101L is adapted for mounting to the electromagnetic actuators 202 by bolts, or other suitable means of attachment. The lower portion 101L also includes eight high current, coil actuating signal terminals 100'*a*–100'*h*, one ground reference indicated as electrically isolated terminal 100'*i*, and six low current, position sensing signal terminals 102'*a*–102'*f* adapted for removable connection to the upper portion 101U by a bolt 106 or other suitable means of attachment. The upper portion 101U of the housing 101 includes eight high current, coil actuating signal terminals 100*a*–100*h*, one ground reference indicated as electrically isolated terminal 100*i*, and six low current, position sensing signal terminals 102*a*–102*f* adapted for removable connection to the lower portion 101L by the bolt 106, or other suitable means of attachment. Referring also to FIG. 3, when the upper portion 101U and lower portion 101L are connected, the electrical connector 99 electrically connects each one of the terminals 100*a*–100*i* to a corresponding one of the terminals 100'*a*–100'*i* and electrically connects each one of the terminals 102*a*–102*f* to a corresponding one of the terminals 102'*a*–102'*f*.

More particularly, with the connector 99 assembled, each one of the terminals 100'*a* through 100'*i* is electrically connected to a corresponding one of the terminals 100*a* through 100*i*, respectively, through connected pairs of electrically isolated electrical conductors 100*a*U, 100*a*L (disposed in the upper and lower portions 101U, 101L, respectively) through 100*i*U, 100*i*L, respectively, as indicted. Likewise, with the connector housing 101 assembled, each one of the terminals 102'*a* through 102'*f* is electrically connected to a corresponding one of the terminals 102*a* through 102*f*, respectively, through connected pairs of electrically isolated electrical conductors 102*a*U, 102*a*L (disposed in the upper and lower portions 101U, 101L, respectively) through 102*f*U, 102*f*L, respectively, as indicted.

Referring also to FIG. 12, electrical conductors 100*a*U through 100*i*U and 100*a*L through 100*i*L are deposed in dielectric inserts 112U and 112L, respectively. Likewise the electrical conductors 102*a*U through 102*f*U and 102*a*L through 102*f*L are disposed in dielectric inserts 114U, 114L, respectively.

As noted above, the connector housing 101 is metallic and conductive. The upper portion 101U has a pair of U-shaped slots 110U, 111U and the lower portion 101L has a pair of slots 110L, 111L, formed therein. Slots 110U and 112U are part of the conductive metallic connector 101U and 101L. The slot walls form two electrical shields around conductors 100*a*U, 100*a*L through 100*i*U, 100*i*L and conductors 102*a*U, 102*a*L through 102*f*U, 102*f*L. Hereafter the slot walls will be referred to as electric shields.

Figure 4:
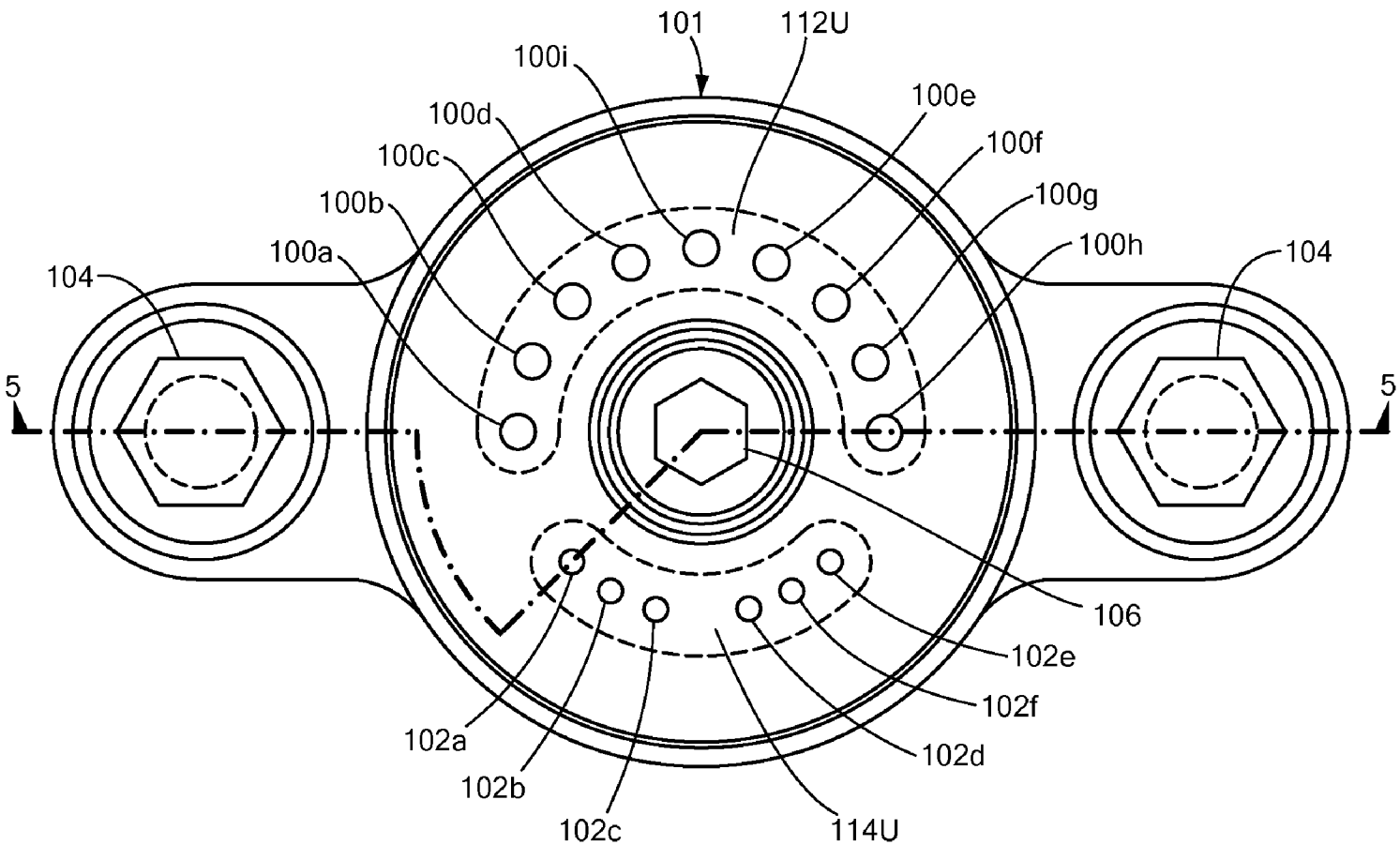
FIG. 4 is a top view of the electrical connector assembly of FIG. 3 according to the invention.
Figure 5:
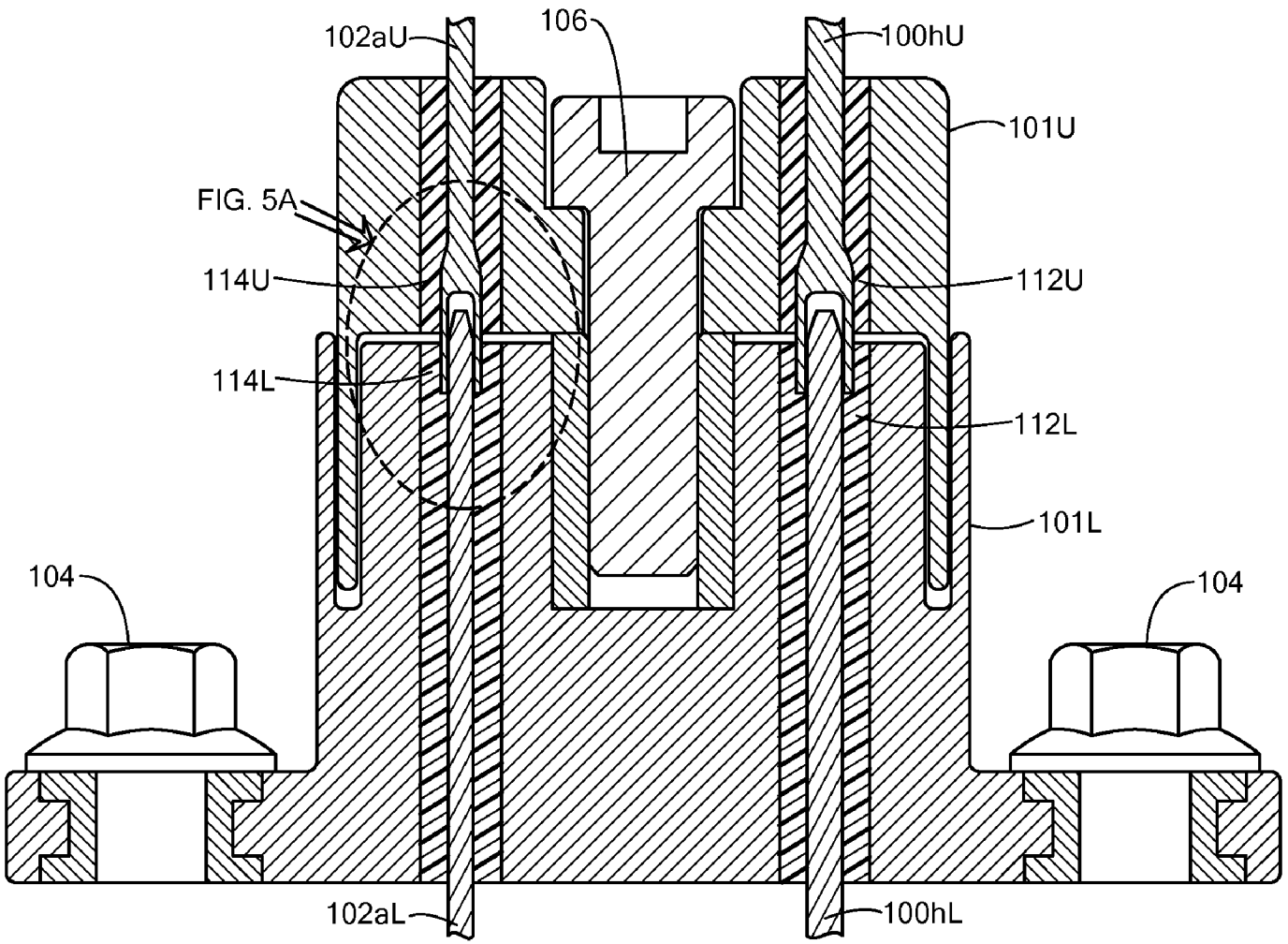
FIG. 5 is a cross-sectional view of the electrical connector assembly of FIG. 4, such cross-section being taken along line 5—5 of FIG. 4.

The dielectric inserts 112U and 114U, with the electrical conductors therein, are disposed in slots 110U and 111U, respectively. Likewise, the dielectric inserts 112L and 114L, with the electrical conductors therein are, disposed in slots 110L and 111L, respectively. The electric shields are electrically connected by virtue of the common electrically conductive housing 101. The upper electric shield due to 110U is connected to ground by housing portion 101U. Likewise, the upper electric shield due to 111U is connected to ground through contact with housing portion 101U and electrical conductor cap 101CAP is electrically connected to housing portion 101U through contact with housing portion 101U. The lower electric shield due to 110L is connected to ground by housing portion 101L. Likewise, the lower electric shield due to 111L is connected to ground through contact with housing portion 101L. Thus, the grounded electric shields electrically shield the high current signals from the low current signals. Referring also to FIGS. 4 and 5, as noted above, the electrical connector housing 101 is removable, having a lower portion 101L mounted to the actuator 202, an upper portion 101U removeably affixed to the lower portion 101L, and a cover portion, 101CAP affixed to upper portion 101U. More particularly, the lower portion 101L is affixed to the actuator 202 (FIG. 1) by bolts 104 (FIG. 5), or other suitable means of attachment, and the upper portion 101U is affixed to the lower portion 101L by a bolt 106, or other suitable means of attachment, and cap 101CAP is affixed to upper portion 101U by an interference fit or other suitable means of attachment.

Figure 9:
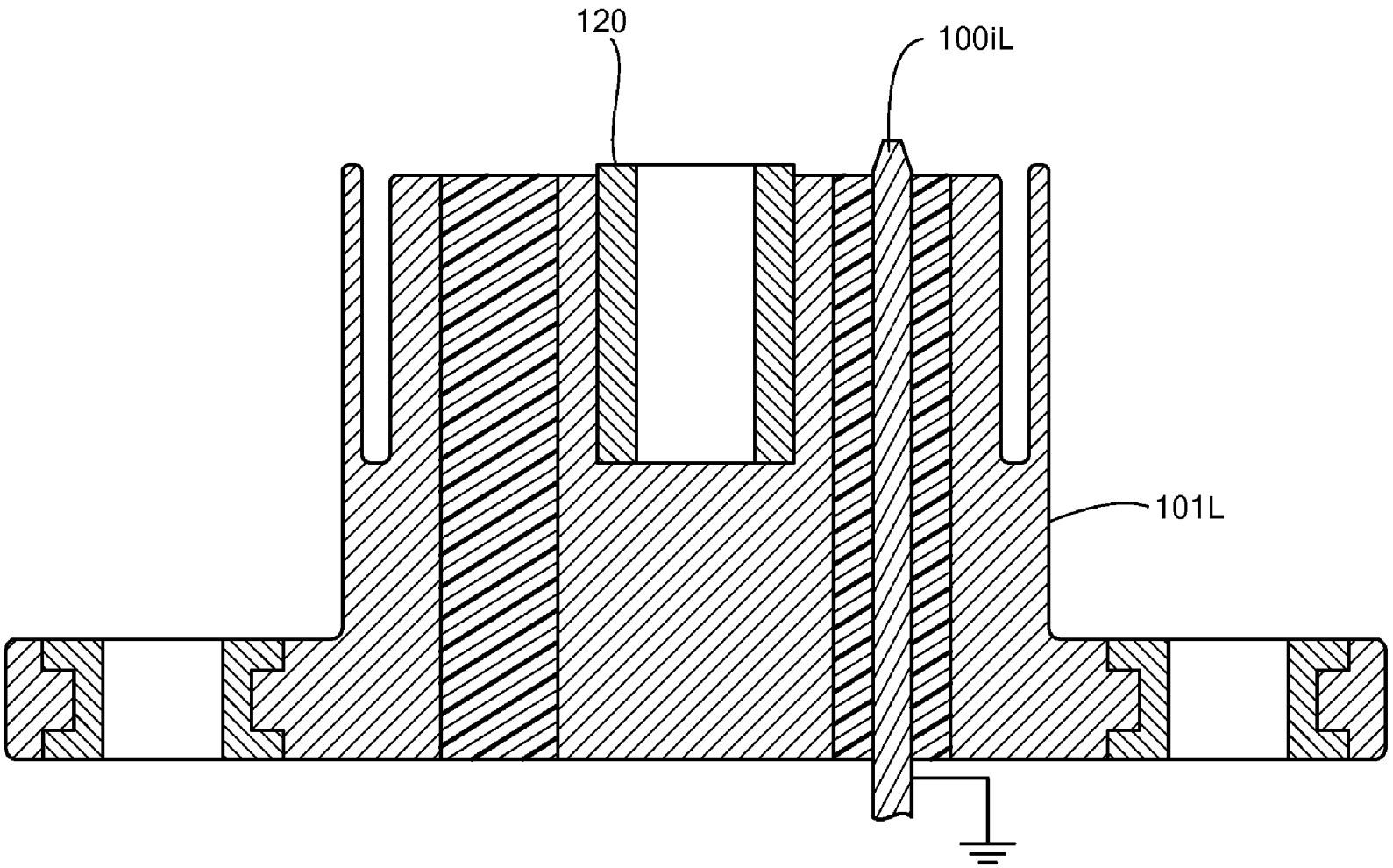
FIG. 9 is a cross-sectional view of the lower portion of the electrical connector of FIG. 8, such cross-section being taken along line 9—9 of FIG. 8.
Figure 11:
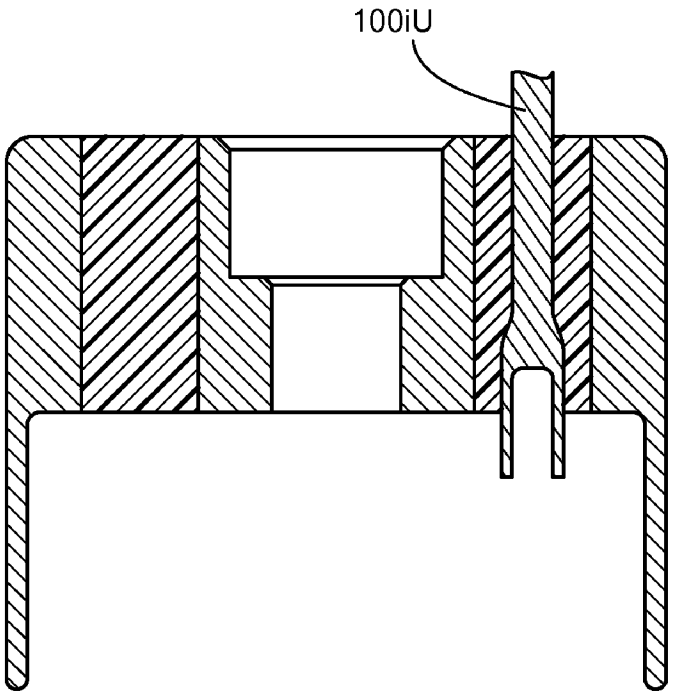
FIG. 11 is a cross-sectional view of the upper portion of the electrical connector of FIG. 10, such cross-section being taken along line 11—11 of FIG. 10.
Figure 10:
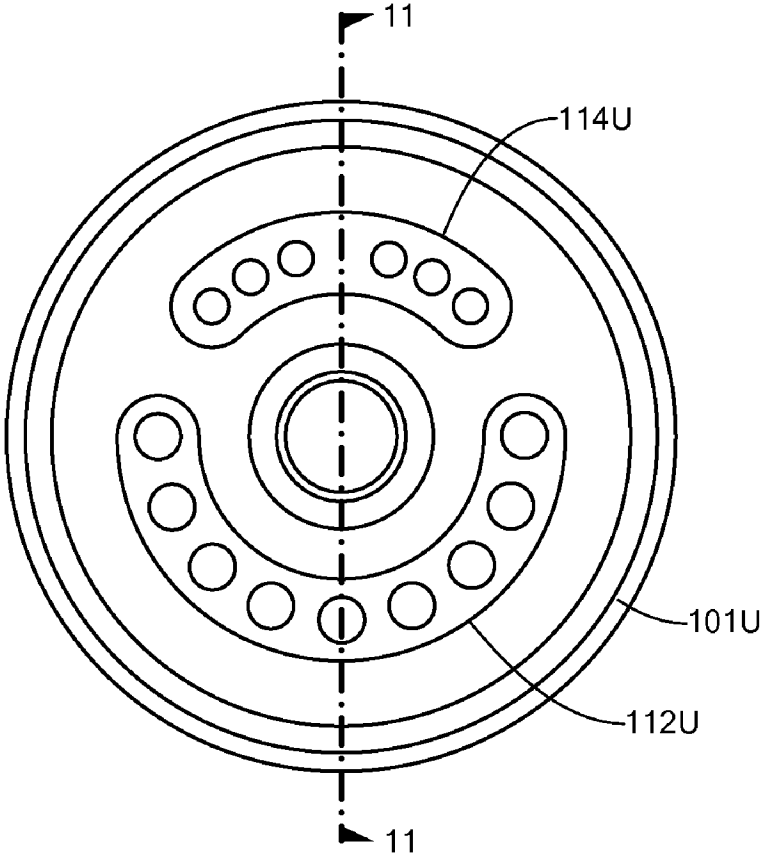
FIG. 10 is a bottom view of the upper portion of the electrical connector of FIG. 4.

The electrical connector 99 (FIG. 12) may be considered as having four main parts: The lower housing portion 101L which provides the actuator connector, the upper housing portion 101U (i.e., an electrical harness connector) which provides the electrical harness connector, the retention bolt 106 and the harness shield cover or cap 101CAP. The actuator connector (i.e., lower portion 101L) is attached to the actuator assembly and provides the wire terminations needed for proper function of the actuator and electrical contact between the metallic outer surface of upper portion 101U and cap 101CAP. The actuator connector (i.e., lower portion 101L) also provides the sealing surface for the seal that is integral with the valve cover, not shown, preventing anything from entering or leaving the engine. This connector lower housing 101L is located in the interior of the engine's valve cover. The dielectric inserts 112U, 112L, 114U and 114L are shown, they would typically be installed into their respective connector housing and remain there during subsequent assembly and disassembly. The electrical harness connector portion 101U provides the wire terminations used to connect the actuator assembly to the valve controller 12 (FIG. 1). This connector portion 101U is external to the engine. The retention bolt 106 physically attaches the two halves of the connector assembly, i.e., upper portion 101U and lower portion 101L, together and prevents loosening under engine operating conditions. For an alternative design where housing 101 is a metal coated plastic housing, metal threaded insert 120 (FIG. 9) is molded or physically inserted into the actuator connector portion 101L to provide a mechanism to mate with the retention bolt 106 (FIG. 12) that is robust and tolerant for reuse. Two bolts 104 (FIG. 5) are used to physically attaching the actuator connector housing 101 to the actuator assembly, 202 (FIG. 1) but other methods could be used, like plastic expanding pins or tabs for example.

Thus, referring also to FIGS. 3, 4, 5, 5A and 12 the nine high current terminals 100*a*–100*i*, one of which (terminal 100*i*) provides a ground reference to the controller have upper portions (i.e. conductors) 100*a*U–100*i*U in passing through the dielectric 112U in electrical connector housing 101. Each one of the upper portions 100*a*U–100*i*U is thereby electrically insulated from each other by dielectric insert 112U in upper portion 101U. Likewise, the nine high current terminals 100*a*–100*i* have lower portions (i.e., conductors) 100*a*L–100*i*L in the lower portion 101L containing the dielectric 112L of the electrical connector housing 101. Each one of the lower portions 100aL–100iL is thereby electrically insulated from each other by such dielectric. Further, each one of the upper portions 100aU–100iU is electrically connected to a corresponding one of the lower portions 100aL–100iL when the upper and lower portions 101U, 101L are affixed together as shown in FIGS. 4 and 5.

In like manner, the six low current terminals 102a–102f (FIG. 3) have upper portions (i.e., conductors) 102aU–102fU in the dielectric insert, 114U, of upper portion 101U of the conductive metallic housing 101 of the electrical connector 99. Each one of the upper portions 102aU–102fU is thereby electrically insulated from each other by such dielectric insert 114U. Likewise, the six low current terminals 102a–102f (FIG. 3) have lower portions (i.e., conductors) 102aL–102fL in the lower dielectric insert, 114L portion 101L of the conductive metallic housing 101 of the electrical connector 99. Each one of the lower portions 102aL–102fL is thereby electrically insulated from each other by such dielectric insert. Further, each one of the upper portions 102aU–102fU is electrically connected to a corresponding one of the lower portions 102aL–102fL when the upper and lower portions 101U, 101L are affixed together as shown in FIGS. 4, 5 and 5A.

Figure 5A:
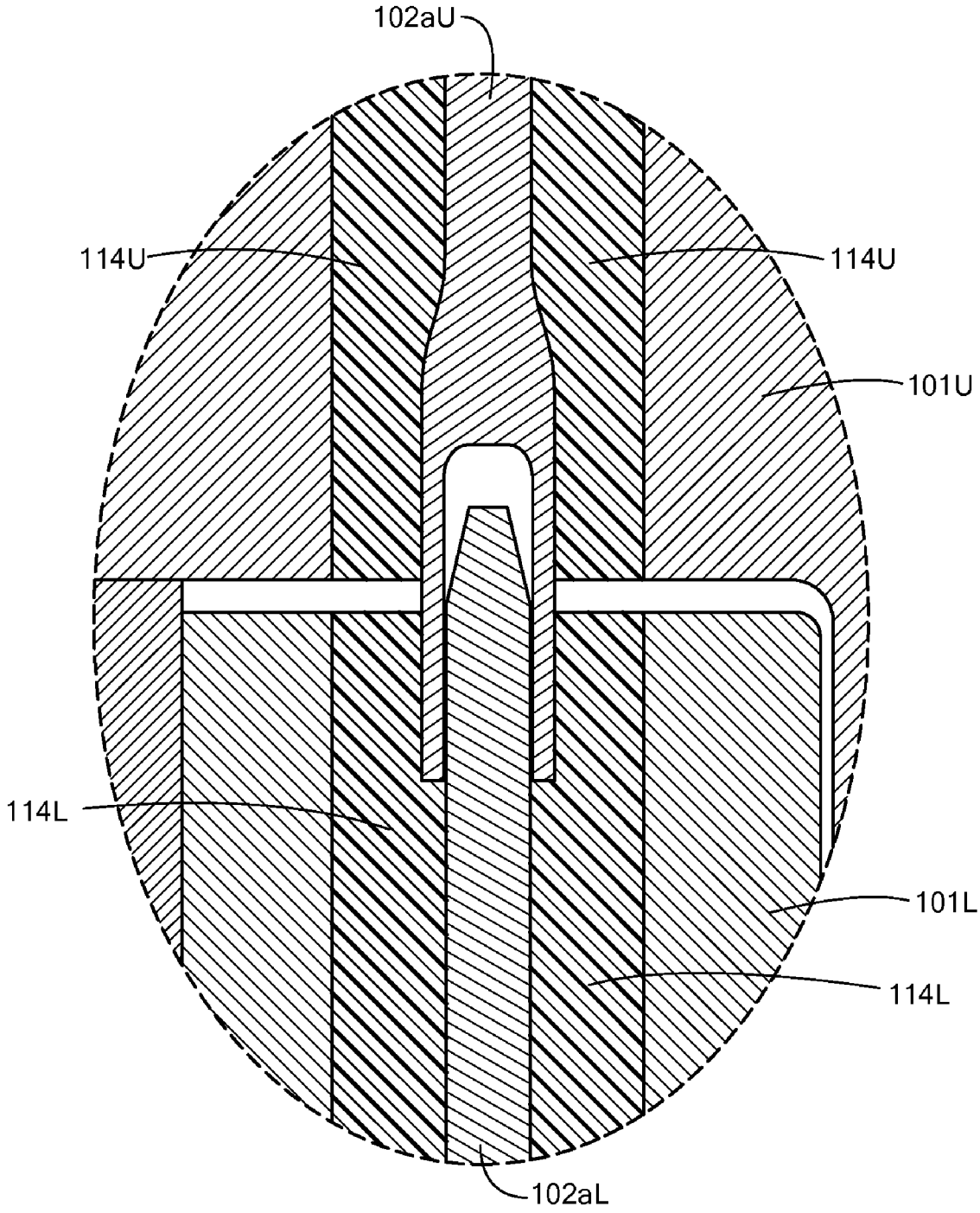
FIG. 5A is an engagement of a portion of FIG. 5, such portion being encircled by the arrow 5A—5A in FIG. 5.
Figure 6:
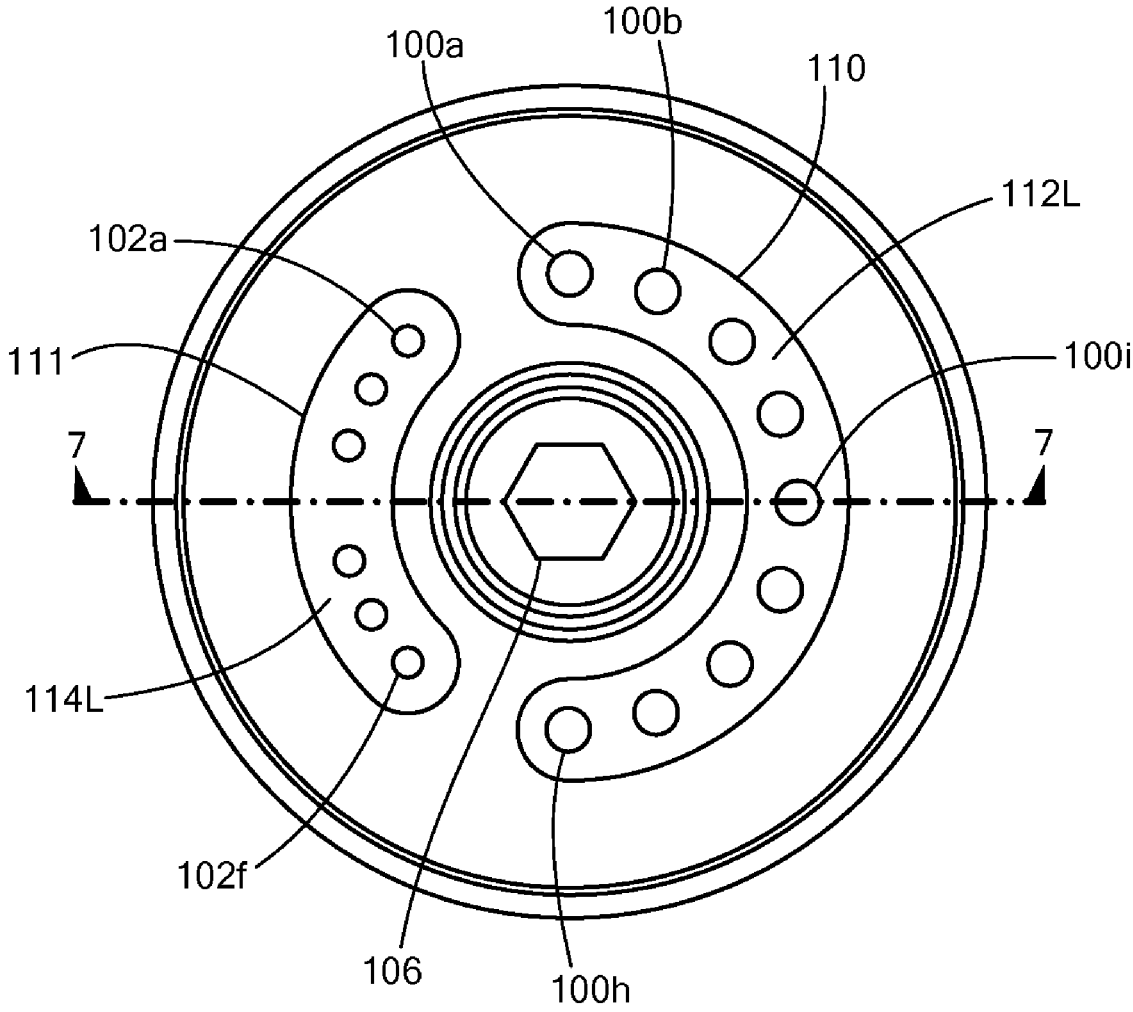
FIG. 6 is a top view of the upper portion of the electrical connector of FIG. 4.

Further, each one of the upper high current conductors 100aU–100iU and each one of the upper low current conductors 102aU–102fU has a cup-shaped, female-connector type end, shown in FIG. 5A for an exemplary one of the conductors 100aU–100iU, 102aU–102fU, here conductor 102aU. Each one of the lower high current conductors 100aL–100iL and each one of the lower low conductors 102aL–102fL has a post type male-connector type end, shown in FIG. 5A for an exemplary one of the conductors 100aL–100iL, 102aL–102fL, here conductor 102aL.

Referring to FIGS. 5 and 5A, an electrical shield is formed around the high current terminals 100a–100i and an electric shield is formed around the six low current conductors 102a–102f. The shields are conductive and part of the metallic conductive housing 101 of the electrical connector and are electrically shielded from each other. Each one of the shields has an upper portion disposed around 112U and 114U of the upper portion 101U of the electrical housing and also lower portions disposed around 112L and 114L of lower portion 101L of the electrical connector 99.

Referring to FIG. 5A, an exemplary one of the low current signal terminals 102a–102f, here 102a is shown in more detail together with housing 101U, 101L and dielectric inserts 114U and 114L. It is noted that the exemplary terminal 102aU, 102aL is electrically insulated from the housing by dielectric 114U in the upper portion 101U and by dielectric 114L in the lower portion 101L. Thus the low current conductors are electrically insulated by 114U and 114L; however, the shielding formed by 110U and 111U (FIG. 12) has a small gap around terminals 102a–102f and 100a–100i. The clearance is provided by the gaps between the electric shields of upper portion 101U and lower portion 101L at the terminal interface between upper portion 101U and lower portion 101L for assembly considerations. The gap is sufficiently small (less than 1 mm) to restrict radiated signals between the high current and low current paths below 300 G Hz.

Referring again to FIG. 4 it is noted that terminal 100i, having an upper portion 100iU in the upper portion 101U (FIG. 3) of 101 and a lower portion 100iL in the lower portion 101L of 101, is provided with the set of high current terminals 100a–100d which supply current to the pair of coils operating one of the pair of valves, and the set of high current terminals 100e–100h which supply current to the pair of coils operating the other one of the pair of valves. This additional pin 100i provides a ground reference between the controller 12 and actuator 202.

Figure 7:
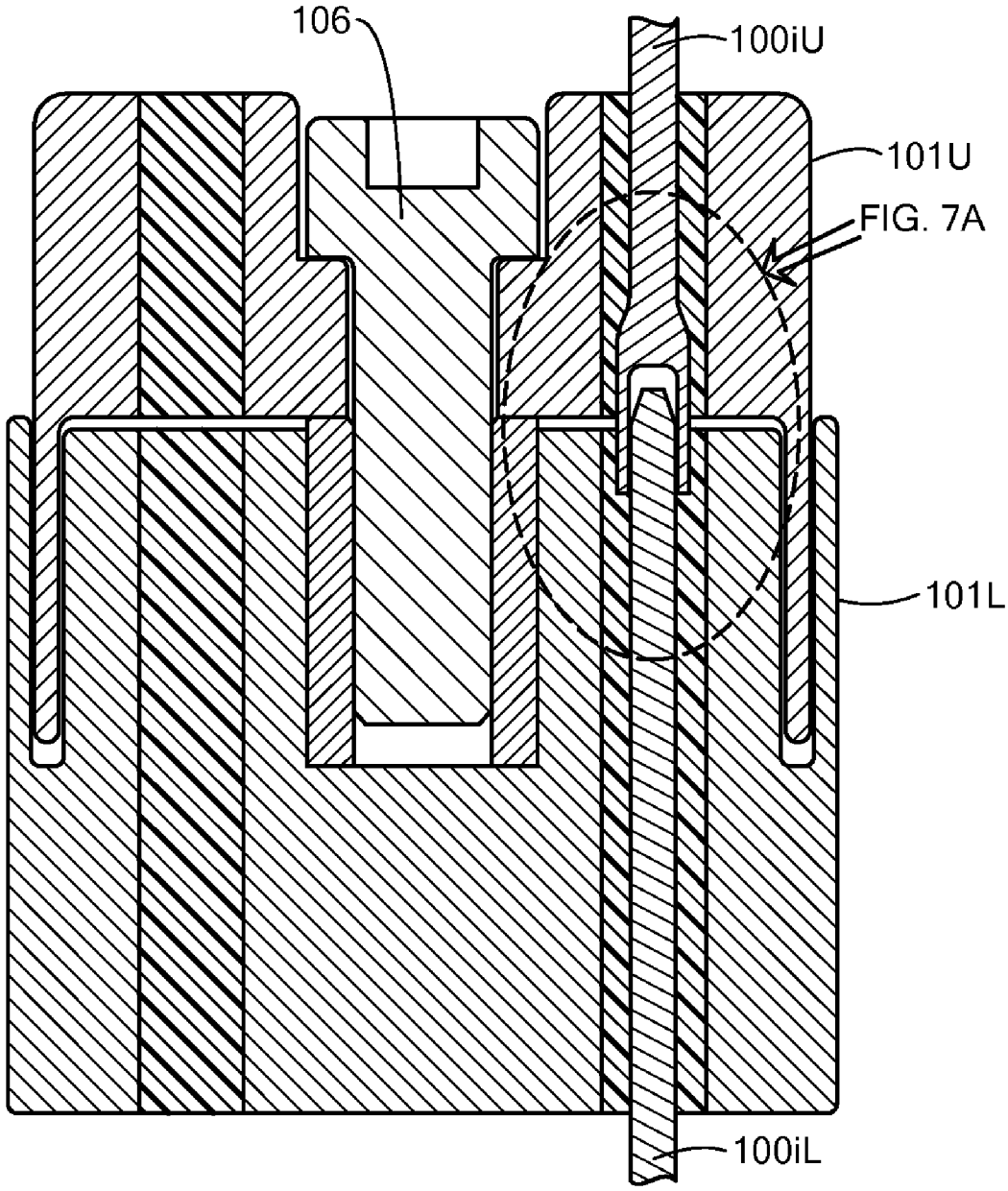
FIG. 7 is a cross-sectional view of the upper portion of the electrical connector of FIG. 6, such cross-section being taken along line 7—7 of FIG. 6.
Figure 7A:
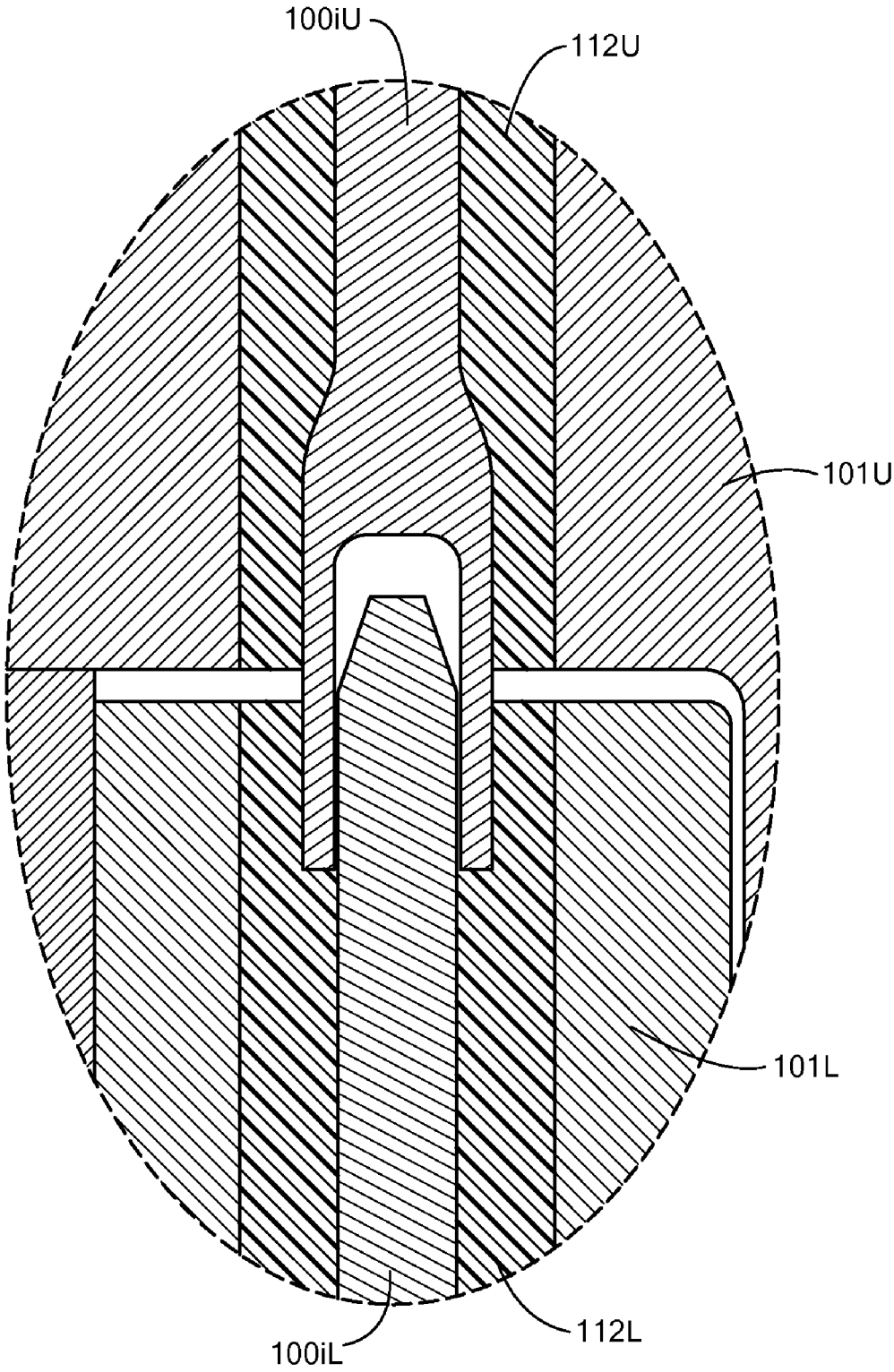
FIG. 7A is an engagement of a portion of FIG. 7, such portion being encircled by the arrow 7A—7A in FIG. 7.
Figure 8:
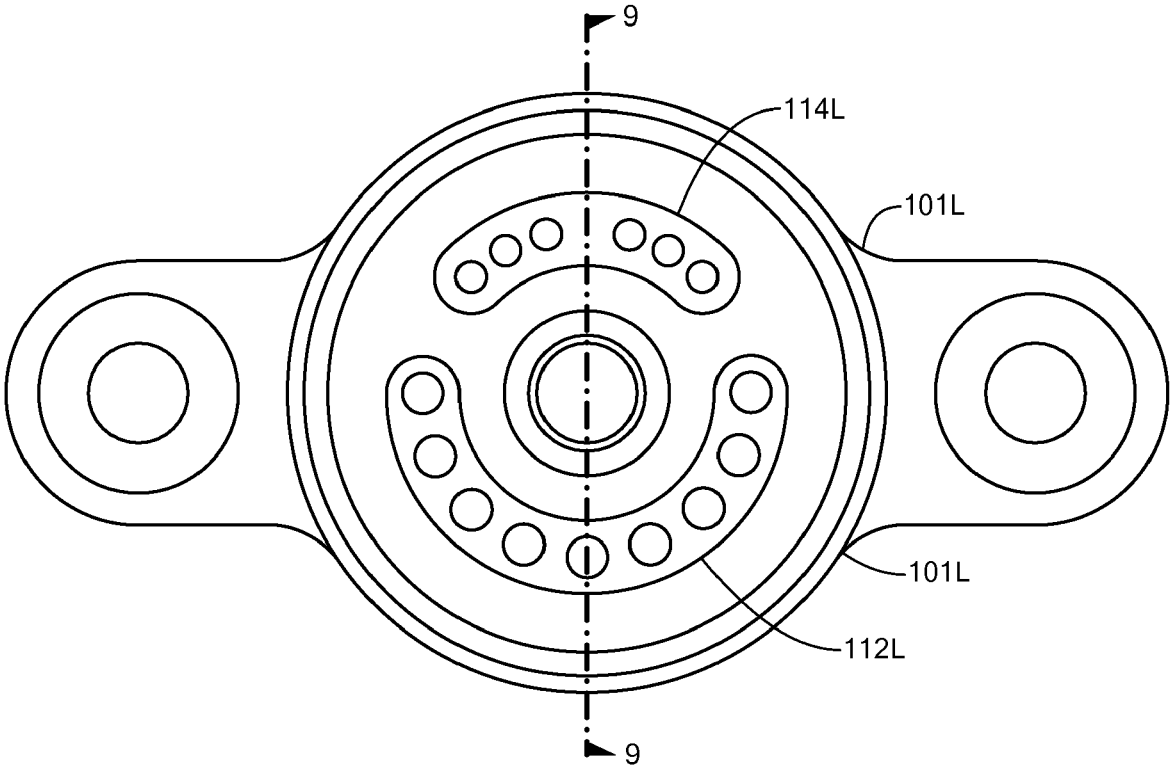
FIG. 8 is a top view of the lower portion of the electrical connector of FIG. 4.

Referring to FIG. 7A, an exemplary of the grounded additional terminal 100i is shown in more detail together with the housing 101U, 101L, slot 110U and 110L providing electric shields, and dielectric 112U and 112L. It is noted that the exemplary terminal 100i is electrically connected to the housing shielding through the mechanical contact to the actuator housing, portions 101L, 101U and cap 101CAP (FIG. 3).

Thus, with the electrical connector 99 described above, electrical current passes through the connector by means of conventional wire conductors, both male and female, as is typical in a conventional electrical connector. The uniqueness of this invention is that the pins are grouped by function of 1) current carrying and 2) signal processing. Separate electric shields occur within portions 101L and 101U because they are metallic and conductive. The connector pins pass freely through clearance holes (i.e. the air gaps) in the dielectrics 112U, 112L, 114U, 114L to avoid contact with the electric shielding.

It is noted that the electric shields have contact with 101U and 101L around their circumference to ensure a robust ground path and 101U, 101L and 101CAP also have contact around their entire circumferences to provide a secondary shielding of all electrical signals from external sources. The wire bundle shields are electrically isolated and terminated in the cap 101CAP such that the wire bundles are shielded within and outside of the assembly. The unique shape of the low and high current contacts also provides the indexing, or alignment feature to make sure that the correct pins are connected to each other. All of the conductors are surrounded by their respective internal shields, one for power transmission (i.e., the high current conductors) and one for signal conditioning (i.e., the low current conductors). One terminal is the ground reference 100i connected to the actuator assembly (FIG. 3). All of the pins can carry current and are isolated from the shield by the dielectric between the pin and shield.

Here, the internal electric shields formed by slots 110U, 111U, 110L, 111L and external electric shield 101L, 101U, 101CAP are made of sheet metal stampings as part of the connector housing. It should be noted that the dielectrics 112U, 112L, 114U and 114L can be easily installed into their respective connector locations and remain in place, even if the connector is disconnected.

From the above, the following features should be noted:

1. Both the high current electrical connections to the electric coils of the electro-magnetic actuator and the low current electrical leads necessary for reporting armature position are packaged within a common housing having an upper portion removeably affixed to a lower portion.

2. The high current connections are both electrically and EMI isolated from the low current wires used for signal processing.

3. Separate EMI shielding is provided for the high current and low current signal wires.

4. The shield path around the high current electrical wires is continued through the connector housing by shielding integral to the connector and a shield path around the low current electrical wires is continued through the connector housing by shielding integral to the connector.

5. The shield path around all the electrical wires is continued through the connector housing by shielding integral to the connector.

6. The grounding pin 100*i* is connected to the electric shields for all portions of the connector housing through interference fits.

7. The outside diameter of the connector that is physically attached to the actuator assembly contains a circular sealing surface for the stationary seal that is separately attached to the valve cover to provide the environmental sealing between the cylinder head and engine compartment.

8. One portion of the connector, portion 101L, is stationary with the actuator assembly and provides environmental sealing with the valve cover, ensuring no foreign manner enters the engine during shipping from the engine assembly plant or during engine servicing.

9. The second portion of the connector, portion 101U, is attached after the valve cover is installed with the internal shields providing the pin alignment feature.

A number of embodiments of the invention have been described. Nevertheless, it will be understood that various modifications may be made without departing from the spirit and scope of the invention. For example, more or less terminals may be used, and there are many possible alternatives for fixedly attaching the lower portion of the connector to the actuator assembly. Also, as noted above the housing 101U, 101L, 101CAP may be a dielectric with metallic coating on the surfaces including the walls of the slots 110U, 110L, 111U, 111L. Alternatively, with such dielectric insert 101U, 101L, the outer walls of the dielectric inserts 112U. 112L, 114U, 114L may be metallic coated with added contact to 100*i* and 100*i*'. Accordingly, other embodiments are within the scope of the following claims.

What is claimed is:

1. An electrical connector for mounting to an electronically controlled valve assembly of an internal combustion engine and for electrically connecting the valve assembly to a control system for the engine, such electrical connector comprising:

a housing;

a plurality of high current conductors disposed with the housing for carrying relatively high current to the electromagnet coils of the valve assembly and a plurality of low current conductors disposed within the housing carrying relatively low current valve position sensing signals from the valve assembly; and wherein such housing provides a common housing for both the plurality of high current conductors and the plurality of low current conductors; and a pair of electrical shields, one of the pair of shields being disposed around the plurality of high current conductors and the other one of the pair of shields being disposed around the plurality of low current conductors.

2. An electrical connector for mounting to an electronically controlled valve assembly of an internal combustion engine and for electrically connecting the valve assembly to a control system for the engine, such electrical connector comprising:

(A) a upper portion comprising:

(i) a plurality of upper high current conductors and a plurality of upper low current conductors;

(ii) a pair of upper electrical shields, one of the pair of upper electrical shields being disposed around the plurality of upper high current conductors and the other one of the pair of upper electrical shields being disposed around the upper low current conductors;

(B) a lower portion comprising:

(i) a plurality of lower high current conductors and a plurality of electrically lower low current, each one being electrically connected to a corresponding one of the plurality of upper high current conductors and the plurality of electrically upper low current conductors;

(ii) a pair of lower electrical shields, one of the pair of lower electrical shields being disposed around the plurality of lower high current conductors and the other one of the pair of lower electrical shields being disposed around the lower low current conductors; and (C) wherein the plurality of high current conductors carry relatively high current to the electromagnet coils of the valve assembly and the plurality of low current conductors carry relatively low current valve position sensing signals from the valve assembly.

3. The electrical connector recited in claim 1 wherein the pair of upper electrical shields are electrically disposed from each other and the pair of lower electrical shields are electrically isolated from each other providing shielding of low current signals from the high current to the electromagnet coils.

4. An electrical connector for mounting to an electronically controlled valve assembly of an internal combustion engine and for electrically connecting the valve assembly to a control system for the engine, such electrical connector comprising:

(A) a upper portion comprising:

(i) a plurality of electrically insulated upper high current conductors and a plurality of electrically upper insulated low current conductors;

(ii) a first upper electrical shield portion disposed around the plurality of upper high current conductors;

(iii) a second upper electrical shield portion disposed around the upper low current conductors;

(B) a lower portion comprising:

(i) a plurality of electrically insulated lower high current conductors and a plurality of electrically lower low current conductors;

(ii) a first lower electrical shield portion disposed around the plurality of lower high current conductors;

(iii) a second lower electrical shield portion disposed around the lower low current conductors;

(C) wherein:

(i) each one of the plurality of upper low current conductors is electrically connected to a corresponding one of the plurality of lower low current conductors;

(ii) the first upper electrical shield portion is connected to the first lower electrical shield portion;

(iii) the second upper electrical shield portion is connected to the second lower electrical shield portion and (D) wherein the plurality of high current conductors carry relatively high current to the electromagnet coils of the valve assembly and the plurality of low current conductors carry relatively low current valve position sensing signals from the valve assembly.

5. An electrical connector for mounting to an electronically controlled valve assembly of an internal combustion engine and for electrically connecting the valve assembly to a control system for the engine, such electrical connector comprising:

(A) a upper portion comprising:

(i) a plurality of electrically insulated upper high current conductors and a plurality of electrically insulated upper low current conductors where the low current conductors carry electrical signals representing position of valves in the valve assembly to the control system; and (ii) a first upper electrical dielectric portion disposed around the plurality of upper high current conductors;

(iii) a second upper electrical dielectric portion disposed around the upper low current conductors;

(iv) wherein the first upper electrical shield portion provides shielding independent from the second upper electrical shield;

(v) a ground reference conductor electrically connected to the actuator and the metallic conductive lower, upper and cap assemblies;

(B) a lower portion configured for mounting to the electronically controlled valve assembly, such lower portion having therein:

(i) a plurality of electrically insulated lower high current conductors for passing current from the plurality of upper high current conductors for electrically activating valve mechanisms within the valve assembly and a plurality of electrically lower low current conductors for carrying electrical signals representing position of valves in the valve assembly to the plurality of upper low current conductors; and (ii) a first lower dielectric portion disposed around, and electrically insulated from, the plurality of lower high current conductors;

(iii) a second lower dielectric portion disposed around, and electrically insulated from, the lower high current conductors;

(iv) wherein the first lower electrical shield portion is disposed from the second lower electrical shield portion;

(v) a ground reference conductor electrically connected to the actuator;

(c) wherein:

(i) each one of the plurality of upper low current conductors is electrically connected to a corresponding one of the plurality of lower low current conductors;

(ii) the first upper electrical shield portion is electrically connected to the first lower electrical shield portion;

(iii) the second upper electrical shield portion is electrically connected to the second lower electrical shield portion;

(iv) the upper ground reference conductor is electrically connected to the lower ground conductor;

(D) wherein the plurality of high current conductors carry relatively high current to the electromagnet coils of the valve assembly and the plurality of low current conductors carry relatively low current valve position sensing signals from the valve assembly.

* * * * *